United States Patent [19]

Shaw et al.

[11] 4,319,987

[45] Mar. 16, 1982

[54] BRANCHED ALKYL ETHER AMINES AS IRON ORE FLOTATION AIDS

[75] Inventors: Donald L. Shaw, Kingwood; Quentin T. McGlothlin, Spring; Barry M. O'Brien, Houston, all of Tex.; John W. Keck; Wilfred L. Freyberger, both of Houghton, Mich.

[73] Assignee: Exxon Research & Engineering Co., Florham Park, N.J.

[21] Appl. No.: 185,456

[22] Filed: Sep. 9, 1980

[51] Int. Cl.[3] ..... B03D 1/02

[52] U.S. Cl. ..... 209/166

[58] Field of Search ..... 209/166, 167; 260/404.5

[56] References Cited

U.S. PATENT DOCUMENTS

| | | | |
|---|---|---|---|
| 2,372,624 | 3/1945 | Carpenter | 260/584 |
| 3,076,819 | 2/1963 | Heise | 209/166 X |
| 3,260,365 | 7/1966 | Dickson | 209/166 |
| 3,363,758 | 1/1968 | Cronberg | 209/166 |
| 3,404,165 | 10/1968 | Budde | 260/404.5 |
| 3,404,777 | 10/1968 | Ray | 209/166 |
| 3,960,715 | 6/1976 | Dicks | 209/166 |
| 4,168,227 | 9/1979 | Polgaive | 209/166 |
| 4,200,522 | 4/1980 | Dorrepaal | 209/166 |

OTHER PUBLICATIONS

Villar, J. W. & Dawe, G. A., New Processing Technique for Iron Ore, Min. Cong. J., Oct. 1975, vol. 61, No. 10, pp. 40–48.

Min. Mag, Jan. 1977, Cationic Silica Flotation, pp. 25–31.

*Primary Examiner*—Robert Halper

*Attorney, Agent, or Firm*—Roland A. Dexter

[57] ABSTRACT

The use of primary aliphatic ether amines as silica collectors in the concentration of minerals by the froth flotation process. More specifically, the use of mixtures of primary methyl branched aliphatic ether amines and the partially-neutralized salts thereof as flotation reagents. In further aspect, the use of mixtures of 3-isooctoxypropyl monoamine and 3-isodecoxypropyl monoamine and/or the partially-neutralized acetate salts thereof as collectors for silica in the beneficiation of oxidized taconite ores.

12 Claims, No Drawings

BRANCHED ALKYL ETHER AMINES AS IRON ORE FLOTATION AIDS

The invention relates to the use of primary branched aliphatic ether monoamines as silica collectors in the concentration of minerals by the froth flotation process. More particularly, it relates to the use of mixtures of partial acid salts of primary branched alkyl ether amines such as 3-octoxypropyl-monoammonium acetate and 3-decoxy propyl mono ammonium acetate a cationic silica collectors in froth flotation of iron ore.

BACKGROUND OF THE INVENTION

Froth flotation is a common process applied to the art of separating or concentrating minerals from ore or the like. Briefly, the flotation process usually comprises grinding crushed ore, classifying the ground ore in water, treating the classified ore by flotation to concentrate one or more minerals while the remainder of the minerals of the ore remain behind in the water pulp, thickening and filtering the separated concentrate and thereafter treating the same for ultimate use of the separated minerals. In carrying out the flotation step, a collector is added to the ore dispersed in the water and air is introduced into the pulp to form a froth, and the froth, containing those minerals that are wetted by the collector and have an affinity for air bubbles, is withdrawn.

A host of selective collecting agents have been developed that are used for forming water-repellant, air-avid surfaces on one mineral or a class of minerals. These collectors are anionic or cationic, and while many of them have been used satisfactorily, they often are limited by their solubility and handling characterisitics, selectivity, effectiveness, stability, cost, etc.

In recent years, the enrichment of non-magnetic taconite iron ore deposits by a selective flocculation/desliming process, followed by froth flotation, has become an important commercial process. The application of this process to a large ore body located on the Marquette Range in Michigan (the Tilden Mine) is described in a paper:

Villar, J. W. and Dawe, G. A., "The Tilden Mine- a New Processing Technique for Iron Ore", Mining Congress Journal, October, 1975, Vol. 61, No. 10, pg. 40–48.

This process utilizes a cationic flotation system following the selective flocculation/desliming step. The purpose of the cationic flotation system is to remove silica from the deslimed ore to produce an iron ore concentrate of commercial grade.

The cationic flotation system employs an amine collector. The principal amine collector utilized in the Tilden process has been an ether amine of the following general structure:

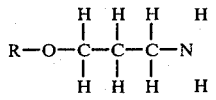

where R—O— is derived from a mixture of normal alcohols consisting predominantly of $C_8$ and $C_{10}$ carbon number alcohols. In use, the amine is typically partially neutralized (~30 percent) with acetic acid to improve water dispersability.

Other mono ether amines offered commercially for iron ore flotation are products where R—O— is derived from normal $C_{10}$ alcohols, methyl branched $C_{10}$ alcohols, normal $C_{12}$–$C_{14}$ alcohols, and normal $C_{16}$–$C_{18}$–$C_{22}$–$C_{26}$ alcohols. Other products which have been mentioned in the patent literature include products derived from normal $C_6$, $C_7$, $C_8$, $C_9$, $C_{10}$, $C_{11}$, $C_{12}$, $C_{13}$, $C_{14}$, $C_{15}$, etc. alcohols and various iso $C_8$ alcohols (see U.S. Pat. No. 3,363,758 for other starting alcohols).

Other products known for cationic flotation of iron ores include fatty amines, fatty beta-amines, various ether diamines (see U.S. Pat. Nos. 3,363,758 and 3,404,165) and, more recently, blends of alkyl amines/-mono ether amines, and alkyl amines/amino ethers (see U.S. Pat. No. 4,168,227).

The collector used in a cationic flotation process for iron ore is desired to achieve many, sometimes conflicting objectives. These requirements are outlined as follows:

1. Produce an Iron Ore Concentrate of Acceptable Quality

The final product must contain a sufficiently high iron content (generally 60+ weight percent Fe) and not exceed a given silica content to meet commercial standards. It is desirable that silica contents not exceed 5–6 weight percent $SiO_2$. In some cases, high purity (2–3 weight percent $SiO_2$) iron concentrates are required.

2. Recover the Maximum Quantity of Iron Consistent with Acceptable Quality

Iron recovery is of major economic importance to the plant operation. For example, improving iron recovery by 1 weight percent from a crude ore assaying 35% Fe increases the return per ton by about 25 cents.

3. Achieve Acceptable Results with a Variety of Iron Ore Types

Variations occur in the specific type of iron ore encountered in day-to-day mining operations. A given deposit of ore may vary significantly in the amount of desired contained iron ore minerals (e.g., martite, hematite, magnetite, geothite, etc.) and in undesired gangue (quartz, clays, etc.). Commercial iron ore technology does not permit controlling the precise composition of the crude ore being fed to the concentrator (although attempts are made to minimize gross changes through control of mining and ore blending operations). Thus, a successful collector must give acceptable results with the normal commercial variations in ore types fed to the concentrator.

4. Be Sufficiently "Persistent" to Yield Acceptable Results Through Several Stages of Froth Flotation Sharp separations between the undesired silica mineral particles and the desired iron-containing mineral particles are not obtained in a single stage of froth flotation. Thus, in commercial practice, to remove enough silica in the Rougher Flotation cells to achieve commercial purity iron ore concentrate in the underflow, considerable amounts of iron ore are also removed in the froth. Loss of this iron would make the process uneconomic. Thus, the froth product from the Rougher Flotation cells is subjected to several subsequent cleaner froth flotation stages to further separate the desired iron ore from the undesired silica.

In theory, collector could be added at each stage of Rougher and Cleaner froth flotation. However, in commercial practice, collector is often added only to the Rougher cells. Even if additional collector is added at some stage of the cleaning process, this causes complications in process control.

As a practical consequence, a commercial collector must "persist" (i.e., continue to cause the silica mineral particles to float) through several stages of cleaner flotation.

It should be noted that this requirement for a successful collector has heretofore not been recognized in iron ore flotation as a specific property of a collector which should be determined.

5. Require Minimum Quantities of Collector to Achieve Acceptable Operations

While costs of collector are relatively small versus, for example, the value of improved iron recovery and/or the cost of unsatisfactory operations, these collector costs are still an important operating cost. It is general commercial practice to minimize the amount of collector used. Thus, collectors which achieve satisfactory operations at minimum treating rates are desired. Stated another way, a collector which gives a relatively flat dose-response curve is preferred, i.e., when the response (% Fe recovered of target quality is plotted as a result of increasing the dose (pounds of collector per long ton of ore) the slope should be small, optimally zero) over a wide range.

6. Continue to Achieve Equal or Improved Response at High Dosages

When plant operations become more difficult (for example, from changes in ore quality, lower water temperatures, and other factors), it is necessary to increase collector dosage to attempt to achieve target quality from the froth flotation operations. With some collectors, an increase of dosage resulted in a loss in selectivity between silica and iron ore, resulting in a drop of Fe recovery, i.e., the slope of the response-dosage curve referenced in (5) is negative at high dosages.

7. Continue to Achieve Good Performance Under Cold Weather Conditions

On the North American Continent, major iron ore deposits are located in Michigan, Minnesota, and Canada. It has been found that performance of the cationic flotation process becomes poorer when water temperatures drop, even though the specific mechanisms which cause this effect are not well understood. It is obviously desirable that a collector suffer the minimum drop in performance under cold water flotation.

It is also desirable, though less important, that a collector have good physical handling properties under cold weather conditions in its concentrated form. Obviously, lower viscosities and lower freezing points offer advantages in product unloading, pumping, and storage. Energy is saved through minimizing the need for heating the product.

The preparation of aliphatic ether primary amines is not only set forth in said U.S. Pat. No. 3,363,758, but also in numerous earlier publications, including U.S. Pat. No. 2,372,624.

It is an object of the invention to provide a cationic collector reagent which performs better than known collectors in meeting the foregoing requirements for the concentration of mineral ores, particularly for iron ores.

SUMMARY OF THE INVENTION

It has been discovered that a partial acetate salt of a mono ether monoamine manufactured from a blend of 50 parts by weight of methyl branched octyl alcohol and 50 parts by weight of methyl branched decyl alcohol provides an improved cationic collector reagent for the flotation concentration of finely ground and deslimed iron ore concentrates.

Within the preferred concept of this invention, the methyl branched $C_8$ and $C_{10}$ alkyl ether monoamine and partially neutralized acid salts thereof used to form the surprisingly useful cationic collector blends can be represented by the general formulae:

$$R—O—CH_2—CH_2—CH_2—NH_2$$

$$(R—O—CH_2—CH_2—NH_3)^+(X)^-$$

wherein R represents a mixture of methyl-branched aliphatic radicals having predominantly 8 or predominantly 10 carbon atoms and X represents a water solubilizing mono or polyvalent anion.

Within the broad concept of this invention the mixture of branched $C_8$ and $C_{10}$ alkyl ether monoamines and the corresponding acid salts found to be surprisingly useful as cationic collector blends can be represented by the general formulae:

$$[R—O—R'NH_2]_{1-n}\bullet[R—O—R'—NH_3]_n^+[X]_n^{(-)}$$

wherein R and X are as previously defined, R' is an alkylene group having from 2 to 5, preferably 3, carbons, and n is zero to 1, preferably 0.1 to 0.5, optimally 0.3.

DETAILED DESCRIPTION OF THE INVENTION

According to an article appearing in *Mining Magazine* January 1977, pages 25-31, entitled "Cationic Silica Flotation", mineral separation by froth flotation requires the use of chemical additives which can be categorized by function into three general types. They are: (1) the collector or flotation reagent which imparts the hydrophobicity to one mineral species, (2) the frother which lowers the aqueous surface tension to produce a semi-stable foam at the air-water interface, and (3) the modifiers or auxiliary reagents which are used to enhance the selective adsorption of the collector to a specific mineral surface and include, in the case of cationic silica flotation, depressants, dispersants, and pH regulators.

The ether monoamine collectors of the invention are by nature cationic surfactants. The amino groups ($—NH_2$) attach to silica and silica materials, providing the required selectivity for flotation, while the ether linkages (R—O—C) give these materials relatively low melting points and good dispersibility. Although useful in free amine form, the collectors of the invention may be partially to fully neutralized for direct dispersion in water.

The primary methyl-branched ether amines and partially to fully neutralized salts thereof preferably employed to obtain mixtures useful in the practice of this invention can be represented by the general formulae:

(a) $R—O—CH_2—CH_2—CH_2NH_2$ *AMINE*

Where R— is a mixture of methyl-branched aliphatic radicals having predominantly 8 to 10 carbon atoms. The number of methyl radicals in said branched aliphatic radical may be from 1 to 5, preferably 2 or 3. Or (b)
$(R—O—CH_2—CH_2—CH_2—NH_3)^+(X)^-$
PARTIALLY-NEUTRALIZED SALT OF AMINE Where R— is as described in formula (a). X may be any water solubilizing mono or polyvalent anion such as fluoride, chloride, iodide, bromide acetate or other organic anion such as oxalate, sulfonate, salicylate and the like, phosphate, borate, nitrate, perchlorate, sulfate, etc.; the preferred anion being acetate.

The degree to which the aliphatic ether amine may be neutralized is such that water dispersibility is sufficient to provide adequate dispersion in the flotation mixtures while remaining liquid . . . said degree of neutralization being from 0 to 100 mole percent, preferably in the 10 to 50 percent range.

The mixtures of methyl-branched alkyl ether amine acetates which may be used in this invention may be prepared from the corresponding methyl-branched, preferably oxo, alcohols or mixtures of alcohols by the well-known cyanoethylation reaction, subsequent catalytic reduction, and neutralization with the conjugate acid of the desired anion.

The "oxo" process is well known for the production of alcohols by passage of olefin hydrocarbon vapors over cobalt catalysts in the presence of carbon monoxide and hydrogen.

The thus prepared methyl-branched alkyl ether amines acetates are liquid which may have low pour points, said low pour point being a desirable property because this eliminates the need for heating storage tanks during cold weather.

R— has been defined above as a mixture of methyl branched, predominantly $C_8$ and $C_{10}$ aliphatic radicals. As used herein, a mixture means that in any useful system for this invention at least a sufficient amount of the $C_8$ or $C_{10}$ component is present that the peculiar beneficial properties of the minor component is perceptible in the collector activities. The weight ratio of the $C_8$ aliphatic component to the $C_{10}$ aliphatic component ranges generally from 1 to 4 to 4 to 1, preferably from 1 to 3 to 3 to 1, optimally 1 to 1. Since it is desirable to use an oxo alcohol as the source of the $C_8$ and $C_{10}$ components, the phrasing predominantly $C_8$ and predominantly $C_{10}$ is appropriate since each oxo alcohol contains alcohols of chain lengths other than the designated isooctanol or designated isodecanol.

The amount of ether monoamine collector blend use in the froth flotation process will vary and be dependent upon such factors as the type of ore being treated, the amount of mineral to be collected, the degree of subdivision of such minerals, the degree of separation desired, the particular weight ratio of the $C_8$ and $C_{10}$ components of the ether monoamine blend, and the degree of neutralization. Functionally expressed, the amount of ether amine acid salt reagent used in such froth flotation process will be that sufficient to achieve a desirable separation. Generally, the amount of ether amine acid salt used will be 0.05 to 2 pounds, preferably 0.1 to 0.3 pound, per ton of ore.

The ether amine acid salt reagent can be employed as a solution or dispersion in water or other solvent and introduced into the ore pulp as such without prior conditioning or can be conditioned with the oe pulp prior to the actual concentration operation. In addition, the reagents of this invention can be used in conjunction with other conventional treating agents such as activators, frothing agents, depressing agent, dispersing agents, etc.

In carrying out the practice of this invention, the general well known technique of the froth flotation process is used. Briefly, the ore, or a concentrate of the ore, is ground and mixed with water to form a pulp. The pulp is placed in a suitable flotation cell or vessel provided with an agitator. Air is introduced into the pulp by means of a sparger and passes through the pulp. The froth that is formed is skimmed off or allowed to overflow. The silica floats away with the froth, leaving the mineral concentrate behind. In this manner, the silica or siliceous material is separated from the desired mineral. Although this invention is particularly applicable in removing silica from iron ore, such as magnetite, it can be used in concentrating any silica-containing minerals or ores, such as hematite, goethite, phosphate rock, etc.

The following examples further illustrate the advantages and objects of this invention, but the various reagents, conditions of treatment, and other details recited in these examples should not be construed to unduly limit this invention.

EXAMPLE 1

Illustrative of the preparation of the alkyl ether monoamines and their respective partially neutralized salts, utilized in the collector evaluations hereafter reported, is the following:

An equal weight mixture of oxoisooctanol and isooxodecanol was reacted with a slight molar excess of acrylonitrile in the presence of sodium methylate over a four hour period at a temperature ranging from 25° C. to 40° C.

The sodium methylate in the reaction mixture was neutralized with acetic acid, followed by filtration of the mixture through filter paper while under reduced pressure.

Hydrogenation was carried out under pressure with a mixture of ammonia and hydrogen in the presence of Raney nickel at from 300 to 600 psig at 140° C. for from 4 to 5 hours. The amine was purified by filtration after which 0.3 mole of acetic acid for each mole of ether amine was added with stirring while keeping the temperature below 43° C.

Aside from commercialy available ether monoamines (clearly referenced hereafter) the various amines reported herein were similarly produced.

EXAMPLE 2

Heretofore it was believed that a given collector composition was either acceptable or unacceptable for a given ore body. Little thought was given to the matter of ore-body variability and how flotation collector structure might be optimized for a specific ore-body subtype.

It has been found that variations occur in the specific type of iron ore encountered in day-to-day mining operations within a given ore body. Two different subtypes of Martite Ore from a single commercial iron ore mining site have been isolated and characterized as seen from Table I.

TABLE I

CHARACTERIZATION OF TWO SUBTYPES OF MARTITE ORE WITHIN THE SAME GENERAL ORE BODY

| General Constituents | Ore "A" Martite and Quartz | Ore "B" Martite, Quartz, and Goethite |
|---|---|---|
| % Fe | 35.9 | 33.6 |
| % $SiO_2$ | 46.3 | 47.5 |
| % Loss on ignition | 0.61 | 2.33 |
| % Goethite in ore (based on LOI data) | 6.0 | 20.0 |

TABLE I-continued

CHARACTERIZATION OF TWO SUBTYPES OF MARTITE ORE WITHIN THE SAME GENERAL ORE BODY

| General Constituents | Ore "A" Martite and Quartz | Ore "B" Martite, Quartz, and Goethite |
|---|---|---|
| Goethite as a % of total contained Fe | 10.0 | 38.0 |

While both subtypes of ore can be separated to some extent through the use of a commercially-available linear-based ether amine collector, the following surprising results were obtained:

(a) As shown in Table II, for Ore Subtype "A", a 50/50 weight percent blend of methyl-branched 3 isodecoxypropyl monoamine acetate and methyl branched 3 isooctoxypropyl monoamine acetate yielded substantially better iron recovery at equivalent grade than did a series of amine collectors. These collectors, ranked in order of recovery effectiveness, are as follows:

1. Methyl-Branched iso $C_8/C_{10}$ oxypropyyl amine acetate.
2. Methyl-Branched isodecyl oxypropyl amine acetate.
3. Linear $C_8/C_{10}$ oxypropyl amine acetate.
4. Methyl-Branched isooctyl oxypropyl amine acetate
5. Commercially-available linear $C_8/C_{10}$ oxypropyl amine acetate (sold as MG-98A3 by Sherex Chemical Co. of Dublin, Ohio, a Division of Schering Co.)
6. Linear octyl oxypropyl amine acetate.
7. Linear decyl oxypropyl amine acetate.

TABLE II

FLOTATION TEST RESULTS: VARIOUS COLLECTORS EMPLOYED UPON MARTITE ORE SUBTYPE "A"

| Collector | Collector dosage, lbs./long ton | Fe Recovery @ 65% Fe Grade | Persistence Index** |
|---|---|---|---|
| (1) Methyl-branched iso $C_8/C_{10}$ oxypropyl amine acetate (50/50 wt. % 3-isooctoxypropylamine acetate and 3-isodecoxypropyl-amine acetate. . . .both neutralized 30%). | 0.20 | 70.7 | 7.54 |
| (2) Methyl-branched iso $C_{10}$ oxypropyl amine acetate (30% neutralized). | 0.20 | 58.8 | 13.5 |
| (3) Linear $C_8/C_{10}$ oxypropyl amine acetate (50/50 wt. % $C_8/C_{10}$ alcohols used in reaction; 30% neutralization level). | 0.20 | 53.4 | 6.88 |
| (4) Methyl-branched iso $C_8$ oxypropyl amine acetate (30% neutralized). | 0.20 | 52.3 | 2.32 |
| (5) Linear $C_8$ oxypropyl amine acetate (30% neutralized). | 0.20 | 45.5 | 3.84 |
| (6) Commercially-marketed linear $C_8/C_{10}$ oxypropyl amine acetate (approximately 55 wt. % $C_{10}$ and 45 wt. % $C_8$ alcohols used in reaction; 30% neutralization level). | 0.25* | 59.6 | 7.84 |
| (7) Linear $C_{10}$ oxypropyl amine acetate (30% neutralized). | 0.25* | 56.2 | 15.2 |
| (8) Primarily linear (slightly branched) $C_9C_{11}$ oxypropyl amine acetate (30% neutralized). | 0.25* | 57.6 | 13.1 |
| (9) 2-ethyl hexyl oxypropyl amine acetate (30% neutralized). | 0.25* | 55.6 | 2.42 |

*Note: Higher dosage levels required for response.

**Persistence Index is defined as the ratio of the weight of material floated in the #4 cleaner stage to weight of material not floated in that stage.

(b) However, as shown in Table III, for Ore Subtype "B", the best collector from the recovery standpoint proved to be a Methyl-Branched $C_8$ oxypropyl amine acetate. The seven collectors, ranked in order of effectiveness, are as follows:

1. Methyl-Branched isooctyl oxypropyl amine acetate.
2. Linear octyl oxypropyl amine acetate.
3. Methyl-Branched $C_8/C_{10}$ oxypropyl amine acetate.
4. Linear $C_8/C_{10}$ oxypropyl amine acetate.
5. Commercially-available linear $C_8/C_{10}$ oxypropyl amine acetate.
6. Methyl-Branched isodecyl oxypropyl amine acetate.
7. Linear decyl oxypropyl amine acetate.

TABLE III

FLOTATION TEST RESULTS: VARIOUS COLLECTORS EMPLOYED UPON MARTITE ORE SUBTYPE "B"

| Collector | Collector dosage, lbs./long ton | Fe Recovery @ 63% Fe Grade | Persistence Index |
|---|---|---|---|
| (1) Methyl-branched iso $C_8$oxypropyl amine acetate (30% neutralized). | 0.25 | 71.25 | 5.82 |
| (2) Linear $C_8$ oxypropyl amine acetate (30% neutralized). | 0.25 | 68.1 | 8.27 |
| (3) Methyl-branched iso $C_8/C_{10}$ oxypropyl amine acetate (50/50 by wt. of $C_8$ and $C_{10}$ alcohols used in reaction; 30% neutralized). | 0.25 | 65.0 | 12.1 |
| (4) Linear $C_8/C_{10}$ oxypropyl amine acetate (50/50 wt. $C_8/C_{10}$; 30% neutralized). | 0.25 | 56.3 | 15.49 |
| (5) Commercially-marketed linear $C_8/C_{10}$ oxypropyl amine acetate (approximately 55 wt. % $C_{10}$ and 45 wt. % $C_8$ alcohols used in reaction; 30% neutralization level). | 0.25 | 54.1 | 9.85 |
| (6) Methyl-branched iso $C_{10}$ oxypropyl amine acetate (30% neutralized). | 0.25 | * | — |
| (7) Linear $C_{10}$ oxypropyl amine acetate (30% neutralized). | 0.25 | * | — |

*Note: Did not produce 63% grade.

From these data it is suggested that the optimum collector reagent from an iron recovery standpoint varies with the particular ore subtype(s) within an ore body. Thus for effective recovery, it would be useful to vary the character of the collector as the nature of the ore subtype(s) vary during the processing of the ore body.

EXAMPLE 3

It has been further determined that another property, that of collector persistence, is critical in the actual performance of a collector in a multi-stage flotation process. In Tables II and III, persistence indices are shown for each collector at the appropriate amine dosage when used upon Ores "A" and "B". Laboratory and actual plant studies have shown that a persistence index of at least 6.5 is necessary for a collector to adequately maintain flotation through a four-stage flotation process.

Persistence index (as used herein and in Tables II and III) is defined as the ratio of the weight of material floated in the #4 flotation cleaner stage to the weight of material not floated in that stage. Therefore, higher persistence indices denote "stronger" flotation properties in the latter flotation stages.

It will be noted that in Table II, collectors 4, 5, and 9 do not exhibit acceptable persistence for the Type "A" ore.

Similarly, in Table III, collector 1, while rated best from the Fe recovery standpoint, does not meet the minimum persistence criteria. Therefore, despite the superiority of collector 1 from a recovery standpoint, its performance in a four-stage flotation process would probably not be optimum. However, this does not preclude the use of reagent 1 (the Methyl-Branched iso $C_8$ oxypropyl amine acetate) in a multi-point addition flotation circuit treating the Type B ore.

EXAMPLE 4

As mentioned previously, in the overall assessment of ether amine collectors, a variety of factors must be weighed. Particularly, germane to the primary ether amines discussed herein is the element of cold weather handling properties.

In Table IV, the ASTM pour point properties of the linear $C_8$ /$C_{10}$ derivative is contrasted with that of the Methyl-Branched $C_8$/$C_{10}$ derivative. As will be noted the contrast is markedly in favor of the Methyl Branched $C_8$/$C_{10}$ material. The relatively-high pour point figures (0 to −15° F.) associated with the linear $C_8$/$C_{10}$ material portends considerable handling properties with this material at normal winter temperatures in the North American iron ore producing regions of Michigan, Minnesota and Canada.

TABLE IV

LOW TEMPERATURE HANDLING PROPERTIES OF PRIMARY ETHER AMINE FLOTATION COLLECTORS

| Collector | No. of Different Samples Tested | Pour Point ASTM Test #D-97-66 |
|---|---|---|
| Methyl-branched iso $C_8$/$C_{10}$ oxypropyl amine acetate (30% neutralized) | 4 | Lower than −80° F. (still liquid) |
| Commercially-marketed linear $C_8$/$C_{10}$ oxypropyl amine acetate (30% neutralized) | 3 | Frozen solid @ 0 to −15° F. |

Perhaps even more germane to the commercial success of this discovery is the cost of the potential ether amines which can be used as the collector reagent. Presented in Table V is our comparison of comparative amine reagent costs based on current raw material costs utilizing a common costing for processing. Table V lists the relative costs indices for those reagents tested on Ores "A" and "B".

TABLE V

COMPARITIVE REAGENT COST INDICES: PRIMARY ETHER AMINE FLOTATION COLLECTORS

| Collector | Relative Cost Index* |
|---|---|
| Methyl-branched iso $C_8$/$C_{10}$ oxypropyl amine acetate (30% neutralized). | 1.00 |
| Methyl-branched iso $C_8$ oxypropyl amine acetate (30% neutralized). | 0.98 |
| Methyl-branched iso $C_{10}$ oxypropyl amine acetate (30% neutralized). | 1.02 |
| Commercially-marketed linear $C_8$/$C_{10}$ oxypropyl amine acetate (55 $C_{10}$/45 $C_8$ by wt; 30% neutralized) OR Linear $C_8$/$C_{10}$ oxypropyl amine acetate (50/50 $C_8$/$C_{10}$ wt. %, 30% neutralized). | 1.21 |
| Linear $C_8$ oxypropyl amine acetate (30% neutralized). | 1.32 |
| Linear $C_{10}$ oxypropyl amine acetate (30% neutralized). | 1.37 |
| 2-ethyl hexyl oxypropyl amine acetate (30% neutralized). | 0.98 |
| Primarily linear (slightly branched) $C_9$/$C_{11}$ oxypropyl amine acetate (30% neutralized). | 1.25 |

*Note: Based upon methyl-branched $C_8$/$C_{10}$ oxypropyl amine acetate as 1.00.

It has seen that the methyl branched oxo alcohol derivatives (iso- $C_8$, iso- $C_{10}$ and iso- $C_8$/$C_{10}$), as well as the 2-ethyl hexyl derivative enjoy a significant cost advantage over the linear (or normal) derivatives. Of the linear derivatives, the 50/50 linear $C_8$/$C_{10}$ oxypropyl amine acetate is the most economical . . . costing 21% more than the similar $C_8$/$C_{10}$ Methyl-Branched derivative.

The following Table VI summarizes key evaluative criteria for the nine flotation reagents considered in these Examples. Ranking are given on a 1–9 basis, best to worst, for each criterion:

TABLE VI

FLOTATION REAGENT CRITERIA SUMMARY

| Reagent | Flotation Performance 1–9 Best to Worst Unacceptable Grade Disqualifies: Ore "A" | Ore "B" | Relative Reagent Cost | Low Temperature Properties 1 = Best, 5 = Poor | Acceptable Persistence Index | Total Score |
|---|---|---|---|---|---|---|
| Methyl-branched iso $C_8$/$C_{10}$ | 1 | 3 | 3 | 1 | yes | 8 |
| Commercial $C_8$/$C_{10}$ linear | 2 | 5 | 5.5 | 5 | yes | 17.5 |
| $C_8$/$C_{10}$ linear | 7 | 4 | 5.5 | 5 | yes | 21.5 |
| Linear $C_8$ | 9 | 2 | 8 | 5 | no* | Dis. |

TABLE VI-continued

| FLOTATION REAGENT CRITERIA SUMMARY | | | | | | |
|---|---|---|---|---|---|---|
| | Flotation Performance 1-9 Best to Worst Unacceptable Grade Disqualifies | | Relative Reagent | Low Temperature Properties | Acceptable Persistence | Total |
| Reagent | Ore "A" | Ore "B" | Cost | 1 = Best, 5 = Poor | Index | Score |
| Methyl-branched iso $C_8$ | 8 | 1 | 1.5 | 1 | no* | Dis. |
| Primary linear $C_9/C_{11}$ | 4 | * | 7 | 5 | yes | Dis. |
| Methyl-branched iso $C_{10}$ | 3 | * | 4 | 1 | yes | Dis. |
| Linear $C_{10}$ | 5 | * | 9 | 5 | yes | Dis. |
| 2-Ethyl Hexyl | 6 | ++ | 1.5 | 1 | no* | Dis. |

*Signifies disqualification because of unacceptable performance.
++Tests not conducted.
*Dis. means disqualified.

As will be noted from Table VI, the Methyl-Branched $C_8/C_{10}$ oxy-propyl monoamine acetate is easily the optimum flotation reagent for the treatment of iron ores comprised of ore subtypes "A" and "B". Six of the reagents tested disqualify because of inadequate flotation of ore subtype "B" (inability to make 63% grade), or because of inadequate persistency.

Of the three remaining structures, the Methyl-Branched iso $C_8/C_{10}$ oxypropyl monoamine acetate is superior from the standpoints of flotation performance on both ores and cost. Persistence was clearly adequate.

These findings illustrating the clear superiority of the branched chain ether amines are especially interesting and surprisingly in light of published literature indicating that the linear—or normal—structures should be superior.

For example, in the AIME book Flotation, Volume 1, 1976, a paper entitled "The Structural Effects of Amine Collectors on the Flotation of Quartz" (A. Bleier, A. D. Goddard, and R. D. Culkarni of Union Carbide) comprises pages 117–147. On page 137, the following statement is made: "Collectors having a structure of $RNH_2$ will be more effective if the alkyl group R is linear, rather than branched."

The invention in its broader aspect is not limited to the specific details shown and described and departures may be made from such details without departing from the principles of the invention and without sacrificing its chief advantages.

What is claimed is:

1. A froth flotation process for separating silica from iron ore, which comprises frothing said ore in an aqueous medium in the presence of 0.1 to 2 pounds per ton of said ore of a water dispersible, liquid mixture of aliphatic ether amines having the general formula:

$$R—O—CH_2—CH_2—CH_2—NH_2$$

wherein R is a mixture of methyl branched aliphatic radicals having predominantly eight and ten carbon atoms and said branching being methyl radicals.

2. The process according to claim 1 wherein said ether amine mixtures are partially or totally neutralized with a solubilizing anion preferably acetate.

3. The process according to claim 2 wherein said anion is acetate.

4. The process according to claim 1 wherein said iron ore is hematite.

5. The process according to claim 1 wherein said iron ore is martite.

6. The process according to claim 1 wherein said iron ore is goethite.

7. The process according to claim 1 wherein said mixture of aliphatic ether amines or salts thereof is an equal weight mixture of the ether amines or salts thereof wherein R—is methyl-branched $C_8$ and $C_{10}$ alkyl radicals.

8. The process according to claim 7 wherein the methyl branched $C_8$ alkyl radicals are a mixture of dimethyl substituted hexyl alkyl radicals and the methyl branched $C_{10}$ alkyl radicals are a mixture of trimethyl substituted heptyl alkyl radicals.

9. A froth flotation process for separating silica from iron ore comprising the step of adjusting the ratio of ether amine or partially-neutralized ether amine components in the dosage in response to the feed ore being processed, said components of the following general formulae:

$$R—O—CH_2—CH_2—CH_2—NH_2$$

or $$(R—O—CH_2—CH_2—CH_2—NH_3)^+(X)^-$$

wherein R—is a mixture of methyl branched aliphatic radicals having predominantly eight and ten carbon atoms, and X is an anion, whereby optimum iron recovery is realized.

10. The process according to claim 9 wherein said feed ore is primarily martite with only small amounts of goethite and said mixture of methyl branched ether amine salts are predominately those derived from an oxo ten carbon alcohol.

11. The process according to claim 9 wherein said feed ore is martite with large amounts of goethite and said mixture of methyl branched ether amine salts are primarily those derived from an oxo eight carbon alcohol.

12. A froth flotation process for separating silica from iron ore comprising the steps of frothing said ore in an aqueous medium in the presence of a mixture of methyl branched ether amines or the partially-neutralized salts thereof of the formula:

$$R—O—CH_2—CH_2—CH_2—NH_2$$

wherein R is a mixture of methyl branched aliphatic radicals having predominantly eight and ten carbon atoms and selecting the ratio of said mixture to give the best recovery for the entire range of mineral content of the feed ore.

13. The process according to claim 12 wherein said ore is martite with from 0 to 30 percent goethite and said mixture of methyl branched ether amine salts are an approximately equal weight mixture of salts wherein R—is dimethylhexyl, dimethyloctyl, or trimethyl heptyl.

* * * * *